United States Patent [19]

Schmissrauter

[11] Patent Number: 4,746,052

[45] Date of Patent: May 24, 1988

[54] TAMPER EVIDENT PACKAGING AND METHOD

[75] Inventor: Mark M. Schmissrauter, Signal Mountain, Tenn.

[73] Assignee: Textile Printing Company, Chattanooga, Tenn.

[21] Appl. No.: 43,598

[22] Filed: Apr. 28, 1987

[51] Int. Cl.[4] ..... B65D 5/42

[52] U.S. Cl. ..... 229/102; 206/631; 206/807; 493/151; 493/183

[58] Field of Search ..... 229/102, 132, 134, 136; 206/631, 807; 493/150, 151, 183

[56] References Cited

U.S. PATENT DOCUMENTS

| | | | |
|---|---|---|---|
| 2,083,158 | 6/1937 | Ramsey | 206/631 |
| 2,317,773 | 4/1943 | Kavanaugh | 206/631 |
| 3,096,918 | 7/1963 | Van Dyke et al. | 206/631 |
| 3,298,595 | 1/1967 | Collura | 206/631 |
| 3,423,005 | 1/1969 | Leibson et al. | 206/631 |
| 4,436,206 | 3/1984 | Kuchenbecker | 206/807 |
| 4,479,588 | 10/1984 | Davis et al. | 206/807 |
| 4,508,226 | 4/1985 | Davis et al. | 229/132 |
| 4,566,627 | 1/1986 | Gendron | 206/807 |

FOREIGN PATENT DOCUMENTS

| | | | |
|---|---|---|---|
| 1156699 | 10/1963 | German Democratic Rep. | 229/132 |

*Primary Examiner*—George E. Lowrance
*Assistant Examiner*—Gary E. Elkins
*Attorney, Agent, or Firm*—Brady, O'Boyle & Gates

[57] ABSTRACT

All sealed flaps of a box or carton are provided with viewing window apertures which are in registration with frangible parts of underlying flaps. The underlying flaps have scored areas in the skin portions thereof to which cold glue is applied for sealing the underlying flaps to the flaps having the window apertures. When any of the flaps having the window apertures are pulled open, the skin portions of the underlying flaps are stripped from the main substrate layers of the underlying flaps within the scored areas. This stripping tears the frangible parts of the underlying flaps, such parts being unscored, leaving roughly torn elements of the frangible parts visible through the viewing window apertures. Attempts to reseal the flaps which have been pulled open are ineffective because the viewable torn elements of the frangible parts cause the tampering to be permanently evident.

11 Claims, 2 Drawing Sheets

FIG.1
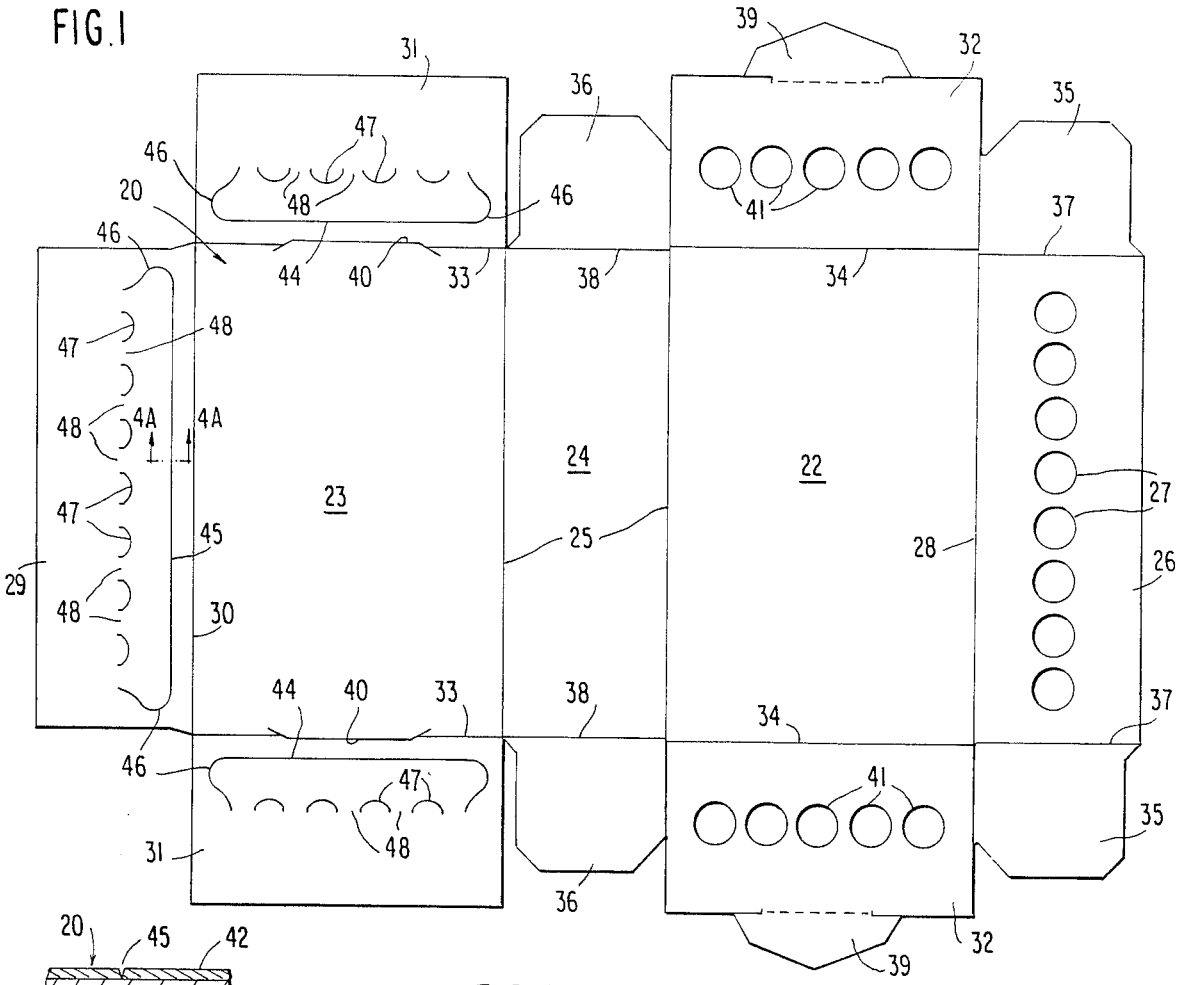
FIG.1A
FIG.2
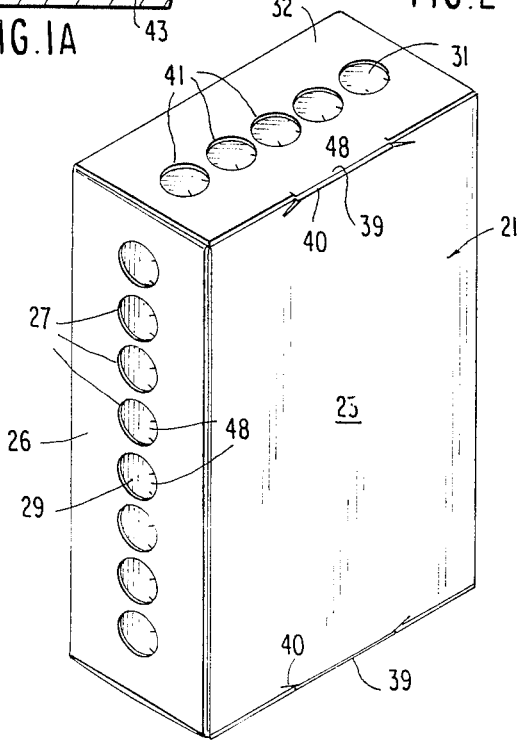
FIG.3a
FIG.3b
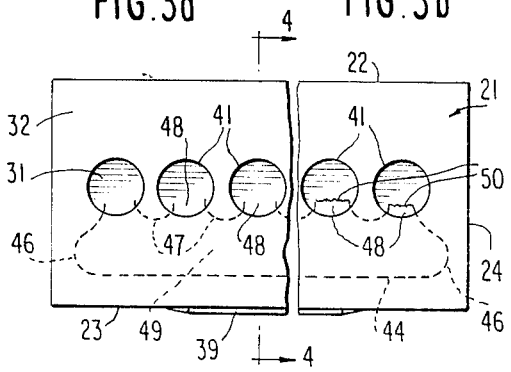
FIG.4
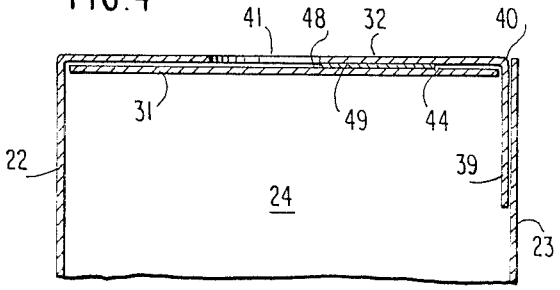

TAMPER EVIDENT PACKAGING AND METHOD

BACKGROUND OF THE INVENTION

1. Technical Field

The present invention relates to tamper evident sealed boxes or cartons.

2. The Prior Art

Tamper evident cartons, broadly speaking, are known in the prior art and are typified in U.S. Pat. Nos. 4,434,896; 4,436,206; 4,479,588; and 4,566,627. The prior art tamper evident cartons in these patents all contain some indicator means responding to the opening of a carton flap which reveals tampering. The degrees of effectiveness of the prior art tamper indicating means vary as does the effectiveness, manufacturing cost, convenience and practicality of the means.

It is the objective of the present invention therefore to provide tamper evident packaging of an improved type, particularly for boxes and cartons having sealed closure flaps which cannot be defeated by attempts to reseal the flaps after they have been torn open, no matter how careful are the resealing efforts.

A further object of the invention is to provide a tamper evident carton which can be produced economically on a mass production basis by state of the art precision die cutting machinery.

Another object of the invention is to provide a tamper evident box or carton characterized by simplicity of construction and reliability, the tamper evidencing means according to the invention being foolproof and impossible to defeat.

Other objects and advantages of the invention will become apparent to those skilled in the art during the course of the following description.

SUMMARY OF THE INVENTION

The present invention is summarized as a box or carton having hinged sealed closure flaps having associated means providing a permanent indication of tampering, as where a sealed flap has been pulled open, followed by an attempt to reseal the flap after tampering with the contents of the carton. The carton is constructed from sheet material having a skin attached to a main substrate layer. Typically, the carton is formed from a paperboard blank having a glossy clay coating. Cold adhesive is employed to seal superposed flaps of the carton to an area defined by scoring which penetrates the skin or coating only. Unscored areas communicate with the adhesive coated scored portion of the flap. An overlying flap covers the adhesive coated scored flap and has viewing windows in registration with said unscored areas. When the overlying flap is opened by an intruder, the skin or coating within the scored area is striped away until the unscored areas are reached, at which points frangible parts of the skin or coating of the underlying flap are broken or torn leaving permanently visible roughly torn elements viewable through said windows of the overlying flap.

BRIEF DESCRIPTION OF THE DRAWINGS

FIG. 1 is a plan view of a blank used in the construction of a tamper evident carton according to the present invention.

FIG. 2 is a perspective view of the tamper evident carton in the closed and sealed state.

FIG. 3*a* is a fragmentary plan view of the carton as depicted in FIG. 2.

FIG. 3*b* is a similar view showing the carton following tampering and resealing.

FIG. 4 is a enlarged fragmentary vertical section taken on line 4—4 of FIG. 3*a*.

FIG. 4*a* is an enlarged fragmentary section taken on line 4*a*—4*a* of FIG. 1.

DETAILED DESCRIPTION

Figure 5:
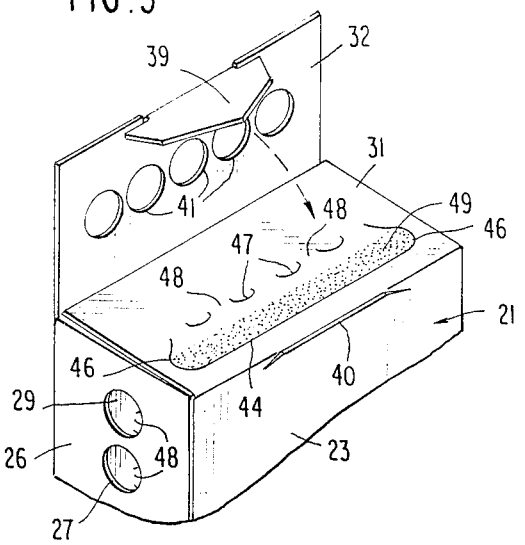
FIG. 5 is a fragmentary perspective view of the carton prior to sealing of an outer closure flap thereof.

Referring to the drawings in detail wherein like numerals designate like parts, FIG. 1 shows a unitary blank 20 employed to construct a tamper evident box or carton 21 in accordance with the present invention. The blank can be formed from a variety of materials including laminated paper stock, solid bleach sulfate, clay coated kraft or a paperboard substrate having a fibrous clay coating. A clay-coated substrate is depicted in the application drawings.

The blank 20 includes a pair of equal size rectangular panels 22 and 23 which form the two major side walls of the carton 21. A comparatively narrow rectangular panel 24 is joined to the panels 22 and 23 along parallel folding lines 25 and is thus disposed between the panels 22 and 23. The panel 24 forms one of the narrow carton side walls. An elongated rectangular closure flap 26 having a series of window apertures 27 formed therethrough is joined to the panel 22 along a longitudinal folding line 28 parallel to the folding lines 25. The flap 26 forms one exterior narrow side surface of the erected carton 21, as shown in the drawings.

Similarly, an elongated rectangular flap 29 is hinged to the panel 23 along a parallel folding line 30 of the blank and in the erected carton 21, FIG. 2, the flap 29 lies beneath the flap 26.

End closure flaps 31 and 32 are provided on the blank 20 at the ends of panels 23 and 22 and are foldable relative thereto on folding lines 33 and 34 extending at right angles to the folding lines 25, 28 and 30. Tabs 35 and 36 foldable on lines 37 and 38 are provided at the end of flap 26 and panel 24. Conventional arrow locks 39 are carried by the flaps 32 to be received in arrow lock slits 40 provided in the blank at the ends of panel 23.

The flaps 32 each contain a series of window apertures 41 identical to the apertures 27 and for the same purpose, to be further described. In the erected carton 21, the flaps 32 lie outermost at the two ends of the rectangular carton and the flaps 31 lie immediately beneath the flaps 32.

In accordance with an important and somewhat critical aspect of the invention, the closure flaps 31 and 29 are scored on their clay-coated sides. Referring to FIG. 4*a*, the thin clay coating is shown by the numeral 42 and the underlying main layer 43 of the blank 20 is shown beneath the coating. The scoring referred to above penetrates the clay coating 42 only and does not penetrate the main layer 43 of the blank to any significant extent. The scoring produces straight scoring lines 44 and 45 in the clay coating of the three flaps near and parallel to the folding lines 33 and 30. At their ends, the scoring lines 44 and 45 have curved terminal portions 46 between which are located a series of short spaced arcuate scoring lines 47. The arcuate scoring lines 47 are near the longitudinal center lines of the flaps 31 and 29 and it may be noted that the window apertures 27 and 41 are also located near the longitudinal center lines of the flaps 26 and 32.

A series of small unscored areas 48 remain on the coated side of the blank 20 between the arcuate scoring lines 47, for an important purpose, to be described.

When the flat blank 20, as shown in FIG. 1, is folded on its several folding lines to produce the rectangular carton 21, the flaps 31 lie beneath the flaps 32 at the opposite ends of the carton and the tabs 35 and 36 lie beneath the flaps 31. Similarly the flap 29 lies beneath the flap 26 along one narrow side of the carton 21. The other narrow side of the carton defined by the panel 24 is without closure flaps and requires no tamper evident means in accordance with the invention. Such means are provided at the two ends and on one narrow side of the carton.

Prior to the closing of the erected carton, a coating 49 or thin layer of cold glue is applied to the areas of the coated faces of the flaps 31 and 29 within the area bounded by the scoring lines 44 and 45 and their end terminals 46, FIG. 5. The small unscored areas 48 are left uncoated with the glue. The flaps 26 and 32 are now pressed down onto the glue-coated flaps 29 and 31 and the arrow lock tabs 39 are inserted into the slits 40 and locked therein. This locking arrangement holds the flaps 26 and 32 against the glue coating 49 while the latter is drying and assures good adherence of the flaps 26 and 32 to the underlying flaps 29 and 31. Without the arrow lock taps 39 and slits 40, the flaps 26 and 32 would have to be held down by some means on the carton manufacturing apparatus during the glue drying period, and the provision of such a means is awkward and expensive.

As best shown in FIG. 3*a*, the viewing or window apertures 41 are offset from the area coated with the cold glue 49. The apertures 41 are in fact in partial registration with the small unscored areas 48 between adjacent arcuate scoring lines 47 of the flaps 31. The same spatial relationship exists between the window apertures 27 of the flap 26 and the unscored areas 48 of the underlying flap 29.

The blank 20 and carton 21 have been described as being formed from a clay-coated paper substrate, such as clay-coated kraft. It has been mentioned that other equivalent materials can be used for the product. In any case, the material will embody a thin skin as indicated at 42 in FIG. 4*a* beneath which is a comparatively thick layer 43 forming the main body portion of the composite substrate.

Figure 6:
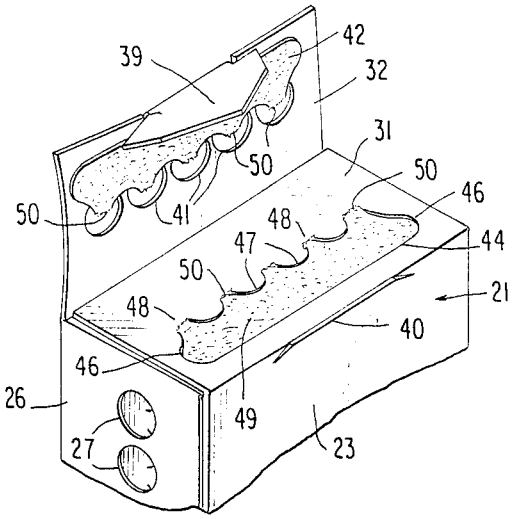
FIG. 6 is a perspective view of the carton with the sealed outer closure flap pulled open to create viewable evidence of tampering as depicted in FIG. 3*b*.

When the carton 21 is closed and sealed on its two ends and one narrow side defined by the flaps 32 and 26, and someone attempts to tamper with the contents of the carton as by pulling open one of the flaps 32, FIG. 6, the following will occur. The resistance offered by the cold glue coating 49 between the flaps 31 and 32 will cause the clay coating 42 or other skin of the flap 31 to be stripped away within the scored area bounded by the score lines 44, 46 and 47. The skin 42 so stripped when the flap 32 is pulled open will remain attached to the flap 32, FIG. 6. When the stripping of the skin from the flap 31 reaches the unscored areas 48, the skin in these small areas will be torn or broken to form a rough edge 50. These rough edges or portions 50 can occur on both the skin 42 adhering to the flap 32 and on the underlying flap 31 within the unscored areas 48.

When the tamperer attempts to reseal the flaps 31 and 31, there will permanently remain very clear evidence of the tampering after the resealing effort, FIG. 3*b*, because the roughly torn edges or fragments 50 will always be viewable through the window apertures 41 and it is virtually impossible to eliminate the fragments 50. The identical permanent tamper evidencing means will be created in the above-described manner when any of the three flaps 26 and 32 are forcibly opened by a tamperer. Subsequently resealing of these flaps will not eliminate the tamper evidencing rough fragments 50.

Figure 7:
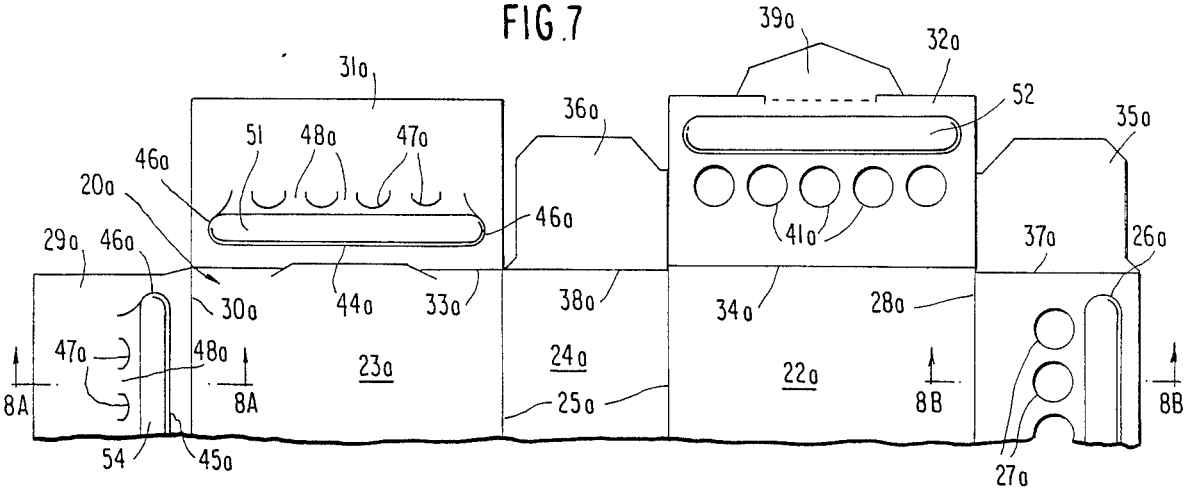
FIG. 7 is a fragmentary plan view of a carton blank according to a modification of the invention.
Figure 8A:
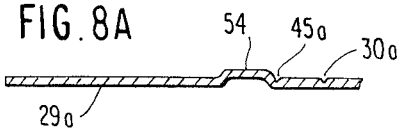
FIG. 8*a* is an enlarged fragmentary section taken on line 8*a*—8*a* of FIG. 7.
Figure 8B:
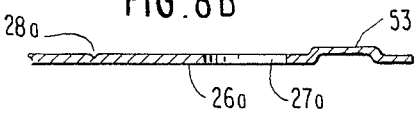
FIG. 8*b* is a similar section taken on line 8*b*—8*b* of FIG. 7.
Figure 9:
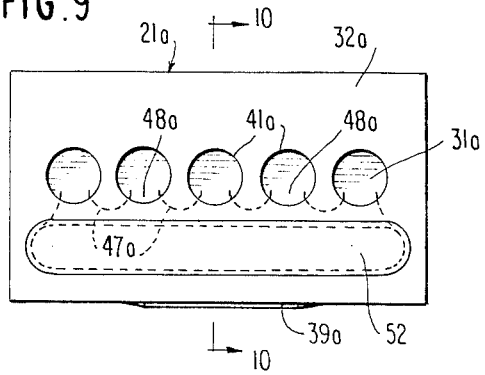
FIG. 9 is an end view of a sealed carton made from the blank of FIG. 7.

FIGS. 7 to 10 show a modification of the invention in which the above-described arrangement for creating the fragments 50 it utilized, plus an embossing arrangement which renders it even more difficult for a tamperer. A portion of a blank 20*a*, similar to the blank 20, is shown in FIG. 7, including panels 22*a*, 23*a* and 24*a*. Closure flaps 26*a* and 29*a* are provided along with closure flaps 31*a* and 32*a* and associated tabs 35*a* and 36*a*. Window apertures 27*a* and 41*a* are formed in the flaps 26*a* and 29*a* and folding lines 25*a*, 28*a*, 30*a*, 34*a* and 33*a* are also provided in the blank 20*a*. The closure flaps 31*a* and 29*a* have scoring lines 44*a* and 45*a* formed through their coatings or skins; as previously described, and scoring line end terminals 46*a* and arcuate scoring lines 47*a* are also provided for the purposes already described in connection with the prior embodiment of the invention.

Additionally, in the modified form of the invention shown in FIGS. 7 to 10, the flaps 31*a* and 32*a* are provided with elongated embossings 51 and 52 within the areas outlined by the scoring lines 44*a* and 46*a*. Similarly, the closure flaps 26*a* and 29*a* have elongated embossings 53 and 54 within the areas bounded by scoring lines 45*a* and 46*a*, FIG. 7.

Figure 10:
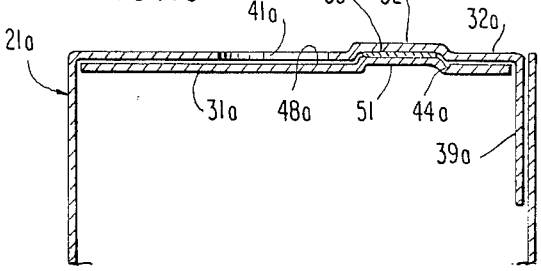
FIG. 10 is an enlarged fragmentary vertical section taken on line 10—10 of FIG. 9.

As best shown in FIG. 10, when the rectangular carton 21*a* is erected from the blank 20*a* in the manner previously described, the embossings 51 and 52 of flaps 31*a* and 32*a* interfit and the same will be true of the embossings 53 and 54 when the flaps 26*a* and 29*a* are folded. The cold glue 55, FIG. 10, is applied to the flaps 31*a* on top of the embossings 51 within the scored area in the same manner shown and described in connection with the prior embodiment. Similarly cold glue is applied on top of the embossing 54 within the scored area on flap 29*a*. The flaps 26*a* and 32*a* are now pressed down onto the flaps 29*a* and 31*a* so that the glue coatings 55 on embossings 51 and 54 are positioned up in the bottoms of the embossings 52 and 53, respectively, above the plane of, or in a plane offset from, the plane between the overlapping flaps 32*a*, 31*a* and 26*a*, 29*a*. The presence of the interfitting embossings 51 and 52, and 53 and 54, make it more difficult for an intruder to enter the package for tampering with its contents, without leaving evidence of such tampering. When the intruder attempts to insert a blade between the flaps 32*a* and 31*a* or between the flaps 26*a* and 29*a* when entering the carton, the blade will cut in the plane between the flaps and will result in cutting through one of the embossings 51 or 54 beneath the glue coating 55, which is offset from this plane, stripping the skin 42 from the flaps within the scored area. The blade on exiting the back side of the embossing 51 or 54 adjacent the unscored areas 48*a*, will cause the skin in these small areas to be torn or broken to form the tamper indicating fragments 50, described in the prior embodiment. Thus, the torn fragments 50 will always be present and viewable through the window apertures in both embodiments of the invention, no matter how the intruder attempts to enter the carton 21 or 21*a*.

Cold glue 55 has been chosen for use in assembling the carton, since it is not susceptible to softening by heat, thus rendering it more difficult for an intruder to enter the carton.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A tamper evident package structure comprising a pair of superposed hinged closure flaps, at least one closure flap constructed of material covered with a strippable skin layer, said one closure flap having scoring line means formed through the skin layer thereof to define a gluing area, said one flap having an unscored area defined by said scoring line means adjacent to and connecting said gluing area on the skin layer to the skin layer beyond said scoring line means, the other closure flap having a window aperture formed therethrough adapted to register with said unscored area, and glue applied to the gluing area bounded by the scoring line means of said one flap and being adhered to the opposing face of the other flap when said flaps are in superposed package-closing relationship, whereby pulling open of said other flap causes said glue to strip the skin layer in said gluing area from said one flap and adherence of the skin layer in said gluing area to said other flap with the creation of a torn fragment of the skin layer at least in the unscored area of said one flap permanently visible through said window aperture of the other flap when the other flap is resealed on said one flap in superposed relationship therewith.

2. A tamper evident package structure as defined in claim 1, and said flaps each being embossed in regions of the gluing area of said one flap and the embossings of said flaps interfitting when the flaps are in superposed relationship.

3. A tamper evident package structure as defined in claim 1, and the gluing area of said one flap being elongated and said one flap having several spaced unscored areas in its skin layer, and the other flap having a corresponding number of window apertures adapted to register with the unscored areas.

4. A tamper evident package structure as defined in claim 1, formed from a unitary foldable blank made from a substrate material which includes a main layer and a comparatively thin skin layer on the main layer in the form of a glossy coating adapted to be stripped from the main layer.

5. A tamper evident package structure as defined in claim 4, and the blank comprising a paper blank and said coating comprising a clay coating.

6. A tamper evident package structure as defined in claim 1, and said package structure comprising a rectangular carton with said hinged closed flaps being provided at least on one end of the carton.

7. A tamper evident package structure as defined in claim 6, and the hinged closure flaps being provided on opposite ends of the carton and on one side wall thereof.

8. A method of producing a tamper evident carton formed from sheet material having a thin skin adapted to be stripped away from an underlying relatively thick layer comprising forming a gluing area on a closure flap of the carton by scoring the skin of such flap substantially surrounding the gluing area, the scoring of said flap having interruptions producing unscored frangible areas in the skin of said flap adjacent to and connecting the gluing area of the skin to the skin outside the gluing area, forming viewing window apertures in another closure flap of the carton adapted to assume a superposed position relative to the first-named closure flap with said viewing window apertures in registration with said unscored frangible areas of the first-named closure flap, applying glue to the first-named closure flap within said gluing area, and adhesively bonding said closure flaps in superposed relationship by means of the glue within the gluing area, whereby opening of the second-named closure flap will strip the skin from the first-named closure flap within the gluing area and tear it away from the skin outside the gluing area in said unscored frangible areas thereby creating permanent tear evidence of tampering in said unscored frangible areas visible through the viewing window apertures registered therewith when the closure flaps are reclosed in superposed relationship.

9. The method of claim 8, and the additional step of embossing said closure flaps substantially in the gluing area in such a manner that the embossings of the closure flaps interfit when the flaps are in superposed relationship.

10. A tamper evident carton formed of sheet material having a strippable skin thereon comprising a pair of carton closure flaps adapted to assume superposed relationship, one closure flap having a viewing window aperture formed therethrough, the other closure flap having score line means through the skin of such flap substantially surrounding and defining a gluing area on the skin and an unscored frangible area on the skin connecting the skin in said gluing area to the skin outside said gluing area, said gluing area lying adjacent to the viewing window aperture and said unscored frangible area lying in registration beneath said viewing window aperture when the flap having the viewing window aperture is superposed on said other flap, and glue applied between said closure flaps within the gluing area whereby opening of the closure flap having the viewing window aperture after hardening of the glue strips said skin in said gluing area at said score line means from the other closure flap and tears said skin in said unscored frangible area to produce a torn skin fragment on the other closure flap viewable through the viewing window aperture registered therewith when the closure flaps are reclosed in the superposed relationship.

11. A tamper evident carton as set forth in claim 10 in which said glue is cold glue.

* * * * *